US005281707A

United States Patent [19]

Fuso et al.

[11] Patent Number: 5,281,707

[45] Date of Patent: Jan. 25, 1994

[54] WATER-SOLUBLE TRIAZINES

[75] Inventors: Francesco Fuso, Müchenstein; Gerhard Reinert, Allschwil, both of Switzerland

[73] Assignee: Ciba-Geigy Corporation, Ardsley, N.Y.

[21] Appl. No.: 928,253

[22] Filed: Aug. 10, 1992

Related U.S. Application Data

[62] Division of Ser. No. 727,514, Jul. 9, 1991, Pat. No. 5,160,346.

[30] Foreign Application Priority Data

Jul. 12, 1990 [CH] Switzerland ..... 2324/90

[51] Int. Cl.[5] ..... C07D 401/12

[52] U.S. Cl. ..... 544/212; 544/198; 544/207; 544/209; 544/113; 540/481; 540/598

[58] Field of Search ..... 544/113, 219, 212, 209, 544/198; 540/481, 598

[56] References Cited

U.S. PATENT DOCUMENTS 3,156,689 11/1964 Dexter et al. ..... 544/219
4,698,064 10/1987 Evans ..... 8/128.3
4,775,386 10/1988 Reinert ..... 8/442
5,030,243 7/1991 Reinert ..... 8/490
5,057,562 10/1991 Reinert ..... 8/442
5,096,456 3/1992 Reinert ..... 8/442

FOREIGN PATENT DOCUMENTS 0378054 7/1990 European Pat. Off. .
4000551 7/1990 Fed. Rep. of Germany .

OTHER PUBLICATIONS

Carr et al., Chemical Abstracts, vol. 107, entry 8796r (1987).
Zhrunal Paikladnoi, 59(5), 1144 ff (1986). (translation)
Journal of Applied Polymer Science, vol. 33(6), pp. 2087–2095 (1987) Carr et al.

*Primary Examiner*—John M. Ford
*Attorney, Agent, or Firm*—George R. Dohmann; Marla J. Mathias

[57] ABSTRACT

There is described a process for the photochemical and thermal stabilization of polyamide fibre materials according to claim 1 and also novel water-soluble triazine derivatives according to claim 7.

The novel process and compounds confer good thermal and photochemical stability on polyamide dyeings and fibres.

4 Claims, No Drawings

WATER-SOLUBLE TRIAZINES

This is a division of Ser. No. 727,514, filed Jul. 9, 1991, now U.S. Pat. No. 5,160,346.

The present invention relates to a process for the photochemical and thermal stabilisation of polyamide fibre materials.

The novel process comprises treating dyed or undyed polyamide fibre materials with water-soluble triazine derivatives of the general formula

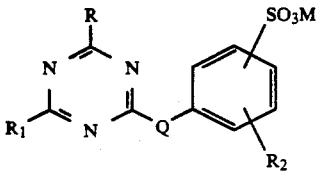

(1)

where $R_1$ is a radical of the formula

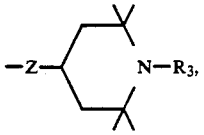

(2)

where $R_3$ is hydrogen or oxido, hydroxyl, lower alkyl, lower alkenyl, lower alkoxy, acyl or benzyl and Z is —O— or —($NR_4$)—, where $R_4$ is hydrogen or lower alkyl, $R_2$ is hydrogen, halogen, lower alkyl, lower alkoxy, acylamino, carboxyl, an unsubstituted or halogen- or (lower alkyl)—substituted phenylsulfo, phenoxy, phenylthio or styryl radical or —$SO_3M$, Q is —O— or —($NR_4$)—, R is halogen, lower alkyl, lower alkoxy, phenyl(lower alkoxy), cycloalkoxy, (lower alkyl)thio, phenyl(lower alkyl)thio, cycloalkylthio, mono(lower alkyl)amino, di(lower alkyl)amino, phenyl(lower alkyl-)amino, cycloalkylamino, phenoxy, phenylamino, phenylthio, phenyl, 1-azacycloalkyl, morpholino, $R_1$ or a radical of the formula

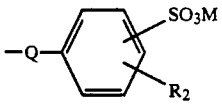

(3)

where M is hydrogen, an alkali metal, an alkaline earth metal, ammonium or an organic ammonium radical, and Q is as defined for the formula (1), the compounds of the formula (1) having not more than 2—$SO_3M$ substituents.

In the definition of the radicals R, $R_2$, $R_3$ and $R_4$, the terms lower alkyl, lower alkoxy, (lower alkyl)thio, mono(lower alkyl)amino and di-(lower alkyl)amino are groups or group constituents which have from 1 to 5, in particular from 1 to 3, carbon atoms. Examples of such groups are methyl, ethyl, n-propyl, isopropyl, n-butyl, sec-butyl, tert-butyl, amyl and isoamyl; methoxy, ethoxy, isopropoxy, isobutoxy, tert-butoxy and tert-amyloxy; and methylthio, ethylthio, propylthio and butylthio. Cycloalkyloxy and cycloalkylthio groups have from 4 to 8, preferably from 5 to 7, carbon atoms. Examples of such groups are cyclobutyloxy, cyclopentyloxy, cyclohexyloxy, methylcyclohexyloxy, ethylcyclohexyloxy, cycloheptyloxy and cyclooctyloxy. The preferred cycloalkyloxy group is cyclohexyloxy.

Lower alkenyl is for example vinyl, propenyl, butenyl or preferably allyl.

Phenyl(lower alkyl)amino is for example phenethylamino, phenylpropylamino, phenylbutylamino or preferably benzylamino.

Halogen in connection with R and $R_2$ is fluorine, bromine or preferably chlorine.

Acyl $R_3$ is in particular formyl, lower alkanoyl, such as acetyl or propionyl, or benzoyl.

Examples of alkali metals are lithium, sodium and potassium. Sodium is preferred. Examples of alkaline earth metals are calcium and magnesium.

A suitable organic ammonium radical is trimethylammonium or preferably triethylammonium.

(Lower alkyl)amino, di(lower alkyl)amino and cycloalkylamino can be substituted by halogen, alkoxy, hydroxyl, carboxyl or carboxyalkyl. Lower alkoxy and cycloalkoxy can be substituted by lower alkoxy. (Lower alkyl)thio and cycloalkylthio can be substituted by alkoxy or hydroxyl. Phenyl can be substituted by lower alkyl. 1-Azacycloalkyl can be substituted by $C_1$–$C_3$alkyl, phenyl, hydroxyl, carboxyl or acylamido. Phenyl can be substituted by lower alkyl, lower alkoxy or halogen. Morpholino can be substituted by one or more $C_1$–$C_3$alkyl radicals.

Of particular interest are water-soluble triazine derivatives where, in the formula (1), R is halogen and $R_1$ is the radical of the formula

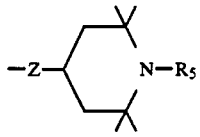

(4)

where $R_5$ is hydrogen or lower alkyl and Z is as defined for the formula (2).

Preference is further given to compounds where, in the formula (1), R and $R_1$ are each a radical of the formula (4).

Also of interest are water-soluble triazine derivatives of the formula (1) where R is a radical of the formula (3) and $R_1$ is a radical of the formula (4).

Also of importance are water-soluble triazine derivatives of the formula (1) where R is lower alkoxy, cycloalkoxy, phenoxy, (lower alkyl)thio, cycloalkylthio or phenylthio and $R_1$ is a radical of the formula (4).

Also of interest are water-soluble triazine derivatives of the formula (1) where R is a radical of the formula

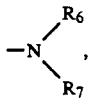

where $R_6$ and $R_7$ are each independently of the other hydrogen, $C_1$–$C_4$alkyl, cycloalkyl or unsubstituted or (lower alkyl)-substituted phenyl with the proviso, that when one of $R_6$ or $R_7$ is hydrogen the other is not hydrogen, or R is 1-azacycloalkyl or morpholino and $R_1$ is a radical of the formula (4) and $R_2$ is as defined for the formula (1).

Some of the water-soluble triazine derivatives used for the process of the present invention are known, for example from Zhurnal Prikladnoi, 59(5), 1144ff (1986), but some are new. The new water-soluble triazine derivatives form a further part of the subject-matter of the present invention and conform to the formula

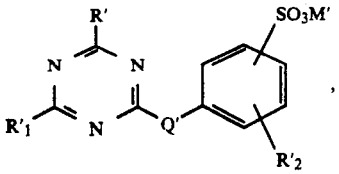

(5)

where $R'_1$ is a radical of the formula

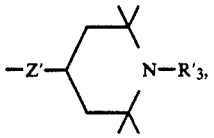

(6)

where $R'_3$ is hydrogen, hydroxyl, lower alkyl, lower alkenyl, lower alkoxy, acyl or benzyl and Z' is —O— or —(NR'$_4$)—, where $R'_4$ is hydrogen or lower alkyl, $R'_2$ is hydrogen, halogen, lower alkyl, lower alkoxy, acylamino, carboxyl, an unsubstituted or halogen- or (lower alkyl)-substituted phenylsulfo, phenoxy, phenylthio or styryl radical or —$SO_3M$, Q' is —O— or —(NR'$_4$)—, R' is halogen, lower alkyl, lower alkoxy, phenyl(lower alkoxy), cycloalkoxy, (lower alkyl)thio, phenyl(lower alkyl)thio, cycloalkylthio, mono(lower alkyl)amino, di(lower alkyl)amino, cycloalkylamino, phenoxy, phenylamino, phenylthio, phenyl, 1-azacycloalkyl, morpholino, $R'_1$ or a radical of the formula

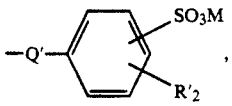

(7)

where $R'_2$ and Q' are each as defined for the formula (5), M' is hydrogen, an alkali metal, an alkaline earth metal, ammonium or an organic ammonium radical, although if R' is chlorine and $R'_2$ is hydrogen $R'_1$ is not a radical of the formula

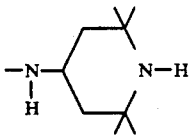

(8)

and if R' is a radical of the formula (7) and Q' is —O—, $R'_2$ is not hydrogen, the compounds of the formula (5) having not more than 2 $SO_3M'$ substituents. Of particular interest are water-soluble triazine derivatives of the formula (5) where R' is halogen and $R'_1$ is the radical of the formula

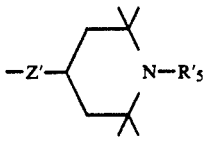

(9)

where $R'_5$ is hydrogen or lower alkyl and Z' is as defined for the formula (6), although when R' is chlorine and $R'_2$ is hydrogen, $R'_1$ is not a radical of the formula (8).

Preference is also given to water-soluble triazine derivatives conforming to the formula (5) where R' is a radical of the formula (7) and $R'_1$ is a radical of the formula (9).

Also of particular interest are water-soluble triazine derivatives conforming to the formula (5) where R' and $R'_1$ are each a radical of the formula (6).

Further important water-soluble triazine derivatives conform to the formula (5) where R' is lower alkoxy, cycloalkoxy, phenoxy, phenylalkoxy, (lower alkyl)thio, phenylthio or phenylalkylthio and Q', $R'_1$ and $R'_2$ are each as defined above.

Also of interest are water-soluble triazine derivatives conforming to the formula (5) where R' is a radical of the formula

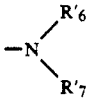

where $R'_6$ and $R'_7$ are each independently of the other hydrogen, $C_1$–$C_4$alkyl, cycloalkyl or unsubstituted or (lower alkyl)-substituted phenyl with the proviso, that when one of $R_6$ or $R_7$ is hydrogen the other is not hydrogen, or R' is 1-azacycloalkyl or morpholino.

The water-soluble triazine derivatives conforming to the formula (5) can be prepared in various ways. The starting compound is in general a 2,4,6-trihalo-s-triazine compound. In those cases where R' is lower alkyl or phenyl the starting compound is always a 2,4-dihalo-6-alkyl- or -6-phenyl-s-triazine.

The novel water-soluble triazine derivatives conforming to the formula (5) are prepared for example by reacting 1 mol of a 2,4,6-trihalo-s-triazine compound or a 2,4-dihalo-6-alkyl- or -6-phenyl-s-triazine in succession with one mole of the compound of the formula

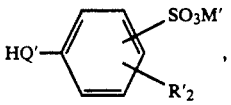

(10)

where M' is hydrogen or an alkali metal and Q' and $R'_2$ are each as defined for the formula (5), with one or 2 mol of the piperidine compounds of the formula

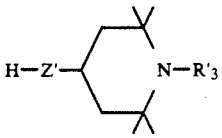

(11)

where $R'_3$ and $Z'$ are each as defined for the formula (6), and, if 1 mol of the piperidine compound of the formula (11) is used, with one mole of a lower alkanolate, cycloalkanolate, phenolate, (lower alkyl)thiolate, cycloalkylthiolate or phenylthiolate compound, a mono(-lower alkyl)amine, a di(lower alkyl)amine, a cycloalkylamine, a phenylamine, a 1-azacycloalkyl or morpholino compound or a compound of the formula (10), the order of the individual reaction steps being freely choosable.

To prepare water-soluble triazine derivatives where R' is halogen, 1 mol of a 2,4,6-trihalo-s-triazine compound is reacted with one mole of a compound of the formula (10) and one mole of the piperidine compound of the formula (11) to give a compound of the formula

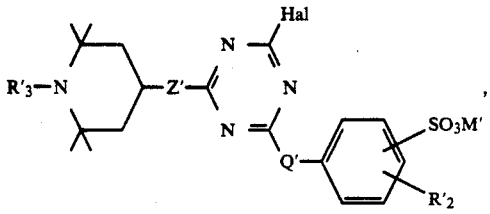

(12)

where $R'_2$, $R'_3$, M', Q' and Z' are each as defined for the formulae (5) and (6). This produces piperidyl-monosubstituted triazine derivatives.

With this form of the reaction the reaction temperature is between 0° and 50° C., preferably between 20° and 40° C., and the reaction time is between 1 and 20, preferably 1 and 4, hours.

The corresponding piperidyl-disubstituted triazine compounds conforming to the formula

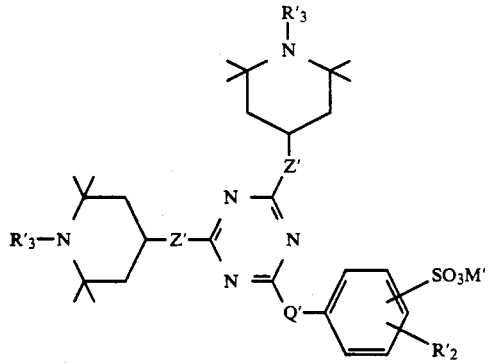

(13)

where $R'_2$, $R'_3$, M', Q' and Z' are each as defined for the formulae (5) and (6), are prepared by reacting the compound of the formula (12) with one mole of the piperidine compound of the formula (11). Water-soluble triazine derivatives conforming to the formula (13) can also be prepared by reacting 1 mol of a 2,4,6-trihalo-s-triazine compound in succession with one mole of the compound of the formula (10) and 2 mol of the piperidine compound of the formula (11). With this form of the reaction the reaction temperature is between 20° and 100° C., preferably between 30° and 80° C. The reaction is carried out by raising the reaction temperature in the course of 2 to 5, preferably 3 or 4, stages during a reaction time of from 1 to 6, preferably 2 to 4, hours.

Water-soluble triazine derivatives where R' is a radical of the formula (7) and $R'_1$ is a radical of the formula (6) are prepared by reacting 1 mol of a 2,4,6-trihalo-s-triazine compound with two moles of the compound of the formula (10), where Q' is —(NR'$_4$)— and $R'_2$ is halogen, lower alkyl, lower alkoxy, acylamino, carboxyl or —$SO_3M'$, and then with one mole of the piperidine compound of the formula (11) to give compounds of the formula

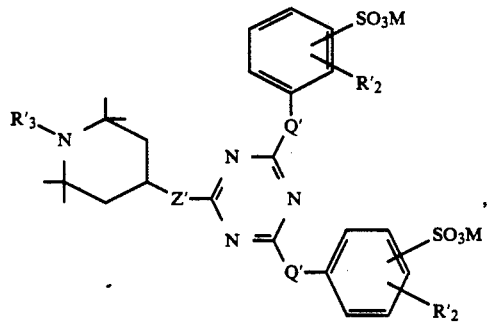

(14)

where Q' is —(NR'$_4$)—, $R'_2$ is halogen, lower alkyl, lower alkoxy, acylamino, carboxyl or —$SO_3H$, and $R'_3$ and Z' are each as defined for the formula (6).

Water-soluble triazine derivatives where R is lower alkoxy, cycloalkoxy, phenylalkoxy, phenoxy, (lower alkyl)thio, cycloalkylthio, phenylthio or phenylalkylthio are prepared by reacting in succession 1 mol of a 2,4,6-trihalo-s-triazine compound with one mole of the corresponding lower alkanolate, phenylalkanolate, cycloalkanolate, phenolate, (lower alkyl)thiolate, cycloalkylthiolate, phenylthiolate or a phenylalkylthiolate compound, one mole of the compound of the formula (10) and one mole of the piperidine compound of the formula (11) to give compounds of the formula

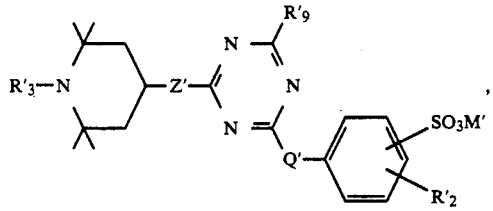

(15)

where $R'_9$ is lower alkoxy, cycloalkoxy, phenylalkoxy, phenoxy, (lower alkyl)thio, cycloalkylthio, phenylthio or phenylalkylthio, and $R'_2$, $R'_3$, M', Q' and Z' are each as defined above. Compounds of the formula (15) are also obtained by reacting one mole of the compound of the formula (12) with one mole of the corresponding lower alkanolate, phenylalkanolate, cycloalkanolate, phenolate, (lower alkyl)thiolate, cycloalkylthiolate, phenylthiolate or phenylalkylthiolate compound.

Water-soluble triazine derivatives where R is mono(-lower alkyl)amino, di(lower alkyl)amino, phenyl(lower alkyl)amino, cycloalkylamino, phenylamino, 1-azacycloalkyl or morpholino are prepared by reacting a 2,4,6-trihalo-s-triazine compound in succession with a compound of the formula (10), a piperidine compound of the formula (11) and an N-alkyl compound or aminophenyl compound to give a compound of the formula

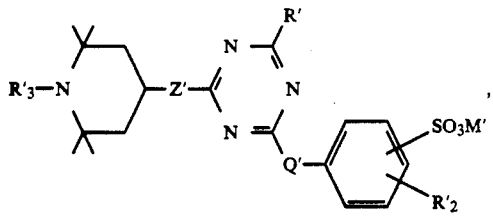

(16)

where R' is a radical of the formula

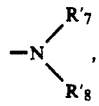

where $R'_7$ and $R'_8$ are each independently of the other hydrogen, $C_1$–$C_4$alkyl, cycloalkyl, unsubstituted or (lower alkyl)-substituted phenyl, with the proviso, that when one of $R'_7$ or $R'_8$ is hydrogen the other is not hydrogen, or R' is 1-azacycloalkyl or morpholino, and $R'_2$, $R'_3$, M', Q' and Z' are each as defined for the formulae (5) and (6). The order of the reactions with the piperidine compound of the formula (11) and the N-alkyl compound depends on the reactivities of the particular compounds. In general, the procedure is to react the 2,4,6-trihalo-s-triazine compound in the first reaction step with the less reactive compound.

The hydrohalic acid formed in the course of the condensation reactions can be bound by the end product itself or by adding a further base, for example aqueous ammonia, alkali metal hydroxides, alkali metal carbonates, bicarbonates or an organic base, for example triethylamine. Preferably, the base used is an alkali metal carbonate, e.g. sodium carbonate.

The reactions advantageously take place in aqueous solution without the addition of organic solvents. The 2,4,6-trihalo-s-triazine starting compounds are generally known. They are preferably used in the form of aqueous suspensions. A particularly preferred starting compound is cyanuric chloride.

All the compounds of the formula (5) are preferably used in the form of the sodium salts. To this end they are dissolved for example with an equivalent amount of sodium hydroxide solution and formulated for use as a solution, dispersion or emulsion.

The process of the present invention and the novel water-soluble triazine derivatives of the formula (5) are suitable for increasing the thermal and photochemical stability of dyed and undyed polyamide fibre materials. The use of the novel compounds for increasing the thermal and photochemical stability of polyamide fibres and dyes thus forms a further part of the subject-matter of the present invention.

The novel and known compounds are representatives of the class of the (sterically) hindered amine light stabilisers (HALS) and can be applied to polyamide fibre materials from customary liquors by conventional methods.

The compounds of the formula (1) are applied according to the present invention from an aqueous bath which contains the compounds in an amount of from 0.005 to 10% by weight, preferably from 0.05 to 2% by weight. Preferably, the compounds are added to the dyebath. They can be applied by an exhaust or continuous method before, during or after dyeing. The application during dyeing is preferred.

In the case of an exhaust method, the liquor ratio can be selected within a wide range, for example within the range from 5:1 to 300:1, preferably from 10:1 to 50:1. It is advantageous to use a temperature of from 30° to 120° C., preferably from 50° to 98° C.

In the case of a continuous method, the wet pick-up is advantageously 30–400% by weight, preferably 75–250% by weight. To fix the applied dyes and the known and novel compounds, the fibre material is subjected to a heat treatment. The fixing process can also be effected by the cold batch method.

The heat treatment is preferably effected by steaming in a steamer with possibly superheated steam at a temperature of from 98° to 105° C. for example from 1 to 7, preferably from 1 to 5, minutes. Fixing the dyes and the compounds of the formula (1) by the cold batch method can take the form of storing the impregnated and preferably rolled-up material at room temperature (15° to 30° C.) for example from 3 to 24 hours, the time required being known to depend on the nature of the applied dye.

On completion of the dyeing process and fixation, the dyeings are conventionally rinsed and dried.

The process of the present invention produces polyamide dyeings and fibres of good thermal and photochemical stability.

Suitable dyeings for the stabilisation according to the present invention are those obtained with acid or metal complex dyes, for example 1:2 chromium or 1:2 cobalt complex dyes or copper complex dyes, but also disperse and reactive dyes.

Examples of such dyes are given in the Colour Index, 3rd edition, 1971, volume 4.

For the purposes of the present invention, polyamide fibre material is synthetic polyamide, for example nylon 6, nylon 6.6 or nylon 12, and also modified polyamide, for example basic-dyeable polyamide. In addition to pure polyamide fibres other possibilities include in particular fibre blends of polyurethane and polyamide, for example tricot material of polyamide/polyurethane in a blend ratio of 70:30. In principle, the pure or blended polyamide fibre material can be present in a very wide range of processing forms, for example as fibre, yarn, woven fabric, knitted fabric, web or pile material.

The present process is particularly advantageous for treating polyamide fibre material which is to be exposed to heat and light, for example automotive upholstery material or carpet.

The examples which follow illustrate the invention. Parts and percentages are by weight.

Preparation of known compounds

EXAMPLE 1

An ice-cold suspension of 10.3 g of 4-N-(2,4-dichloro-6-triazinyl)aminobenzenesulfonic acid (sodium salt) in 100 ml of distilled water is admixed with 4.7 g of 4-amino-2,2,6,6-tetramethylpiperidine by high-speed stirring. The temperature is allowed to rise to room temperature and the mixture is subsequently stirred at 35° C. for an hour. After cooling down to room temperature, the reaction mixture is treated with 1.6 g of sodium carbonate and stirred for 15 hours. The suspension is filtered, and the filter residue is washed with distilled water and dried at 40° C. under reduced pressure. This leaves 12.8 g of a colourless powder of the formula

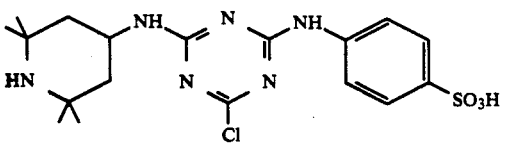

(101)

The compound has the longest-wavelength absorption maximum at 282 nm (1:1 water/DMF).

EXAMPLE 2

A suspension of 10.3 g of 3-N-(2,4-dichloro-6-triazinyl)aminobenzenesulfonic acid (sodium salt) in 100 ml of distilled water at 5° C. is admixed with 4.7 g of 4-amino-2,2,6,6-tetramethylpiperidine. The internal temperature is allowed to rise to 20° C. and the mixture is subsequently stirred at that temperature for 2 hours. The mixture is then allowed to stand at room temperature for 15 hours. The resulting precipitate is filtered off with suction, washed chloride-free with distilled water and dried at 40° C. under reduced pressure. This leaves 11.7 g of a colourless compound of the formula

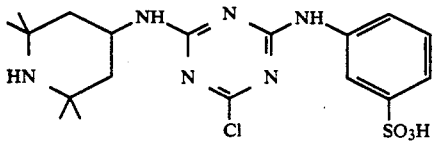

(102)

having the longest-wavelength absorption maximum at 266 nm (water).

Preparation of novel compounds

EXAMPLE 3

Example 1 is repeated, except that the 4.7 g of 4-amino-2,2,6,6-tetramethylpiperidine are replaced by 5.1 g of 4-amino-1,2,2,6,6-pentamethylpiperidine. This produces 13.4 g of a colourless powder of the formula

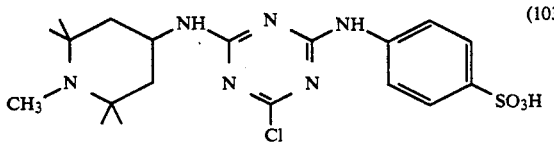

(103)

The compound has the longest-wavelength absorption maximum at 282 nm (1:1 water/DMF).

Example 4

Example 1 is repeated, except that the 4.7 g of 4-amino-2,2,6,6-tetramethylpiperidine are replaced by 4.7 g of 4-N-methylamino-2,2,6,6-tetramethylpiperidine. This produces 12.2 g of a colourless compound of the formula

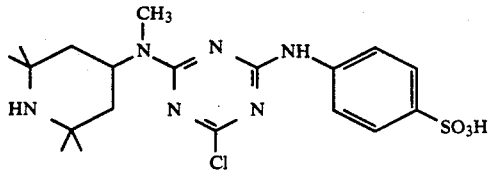

(104)

The compound has the longest-wavelength absorption maximum at 275 nm (water).

EXAMPLE 5

An ice-cold suspension of 10.3 g of 4-N-(2,4-dichloro-6-triazinyl)aminobenzenesulfonic acid (sodium salt) in 80 ml of distilled water is admixed with 4.7 g of 4-hydroxy-2,2,6,6-tetramethylpiperidine. Then 2.5 g of sodium bicarbonate are added. The temperature is allowed to rise to room temperature and then the mixture is heated at 30°–40° C. for 4 hours. After cooling down to room temperature, the reaction mixture is neutralised with concentrated hydrochloric acid and admixed with 8 g of sodium chloride. The suspension is filtered, and the filter residue is washed with 10% sodium chloride solution and dried at 60° C. under reduced pressure. This leaves 14.4 g of a colourless powder of the formula

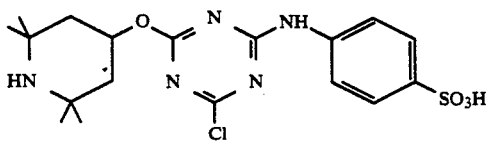

(105)

having an active content of 81%. The longest-wavelength absorption maximum is 277 nm (water).

EXAMPLE 6

A suspension of 10.3 g of 4-N-(2,4-dichloro-6-triazinyl)aminobenzenesulfonic acid (sodium salt) in 100 ml of distilled water at 0° C. is admixed with 11.2 g of 4-amino-1,2,2,6,6-pentamethylpiperidine. The temperature is allowed to rise to 20° C. and the mixture is stirred at that temperature for 3 hours. It is then stirred at 35° C. for a further 2 hours and at 75° C. for 8 hours. After cooling down, the precipitate formed is filtered off, washed with a little distilled water and dried at 40° C. under reduced pressure. This leaves 11.8 g of a colourless compound of the formula

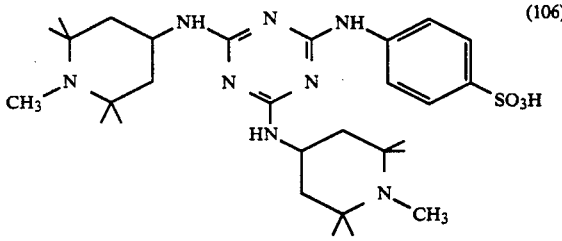

(106)

The longest-wavelength absorption maximum is 273 nm (water).

EXAMPLE 7

A suspension of 5.2 g of 4-N-(2,4-dichloro-6-triazinyl-)aminobenzenesulfonic acid (sodium salt) in 80 ml of distilled water is admixed at 0° C. with 9.4 g of 4-amino-2,2,6,6-tetramethylpiperidine. The temperature is allowed to rise to room temperature and the mixture is subsequently heated at 35°, 45° and 90° C. for 1 hour each. The reaction mixture is then cooled down to 70° C. and admixed with 12% of sodium chloride. The mixture is further cooled down to room temperature and stirred at room temperature for 4 hours. The precipitate is filtered off, washed with sodium chloride solution and dried at 50° C. under reduced pressure.

This leaves 11.7 g of a colourless compound of the formula

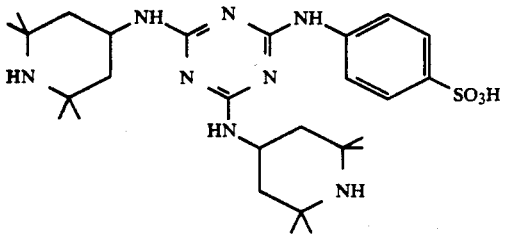

(107)

having an active content of 68%. The longest-wavelength absorption maximum is 273 nm (water).

EXAMPLE 8

Example 7 is repeated, except that the 9.4 g of 4-amino-2,2,6,6-tetramethylpiperidine are replaced by 10.2 g of 4-N-methylamino-2,2,6,6-tetramethylpiperidine. This produces the compound of the formula

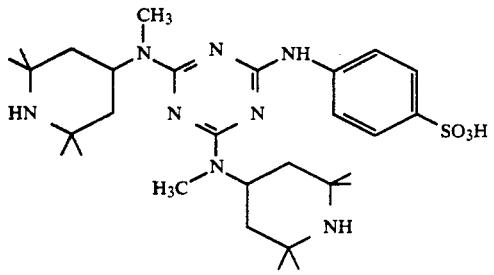

(108)

having an active content of 94%. The compound has the longest-wavelength absorption maximum at 275 nm (water).

EXAMPLE 9

An ice-cold suspension of 10.3 g of 4-N-(2,4-dichloro-6-triazinyl)aminobenzenesulfonic acid (sodium salt) in 350 ml of distilled water is admixed with 2.8 g of aniline, added over 5 minutes. At the same time the pH of the reaction mixture is maintained at 6 by the dropwise addition of 2M sodium hydroxide solution. The amount of sodium hydroxide solution needed is 15 ml. The internal temperature is allowed to rise to 20° C., the mixture is diluted with 30 ml of distilled water and then stirred at from 30° to 35° C. for 1 hour. Then 4.7 g of 4-amino-2,2,6,6-tetramethylpiperidine are added and the mixture is stirred at 70° C. for 15 hours. After cooling down to room temperature, the precipitate formed is filtered off with suction, washed chloride-free with distilled water and dried at 50° C. under reduced pressure. This leaves a quantitative amount of a colourless compound of the formula

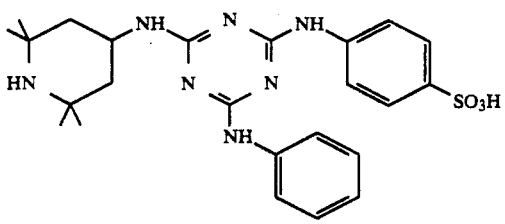

(109)

The compound has the longest-wavelength absorption maximum in water at 277 nm.

EXAMPLE 10

Example 2 is repeated, except that the 4.7 g of 4-amino-2,2,6,6-tetramethylpiperidine are replaced by 5.1 g of 4-N-methylamino-2,2,6,6-tetramethylpiperidine. The product is a compound of the formula

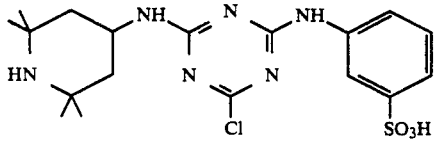

(110)

which has the longest-wavelength absorption maximum at 235 nm (water).

EXAMPLE 11

Example 2 is repeated, except that the 4.7 g of 4-amino-2,2,6,6-tetramethylpiperidine are replaced by 5.1 g of 4-amino-1,2,2,6,6-pentamethylpiperidine. This produces a compound of the formula

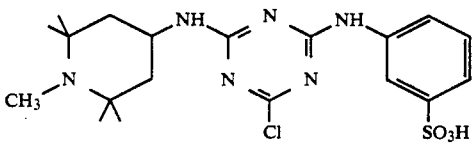

(111)

The longest-wavelength absorption maximum is 269 nm (water).

EXAMPLES 12 to 14

The following compounds (Table I) can be prepared by the method described in Example 2:

TABLE I

| Example | $R_1$ | $R_2$ | $\lambda_{max}$ |
|---|---|---|---|
| 12 (112) | 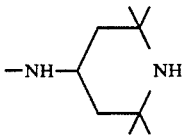 | 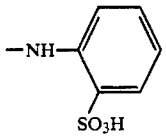 | 268 nm |

TABLE I-continued

| Example | $R_1$ | $R_2$ | $\lambda_{max}$ |
|---|---|---|---|
| 13 (113) | 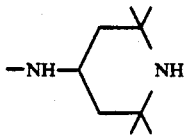 | 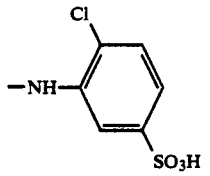 | 261 nm |
| 14 (114) | 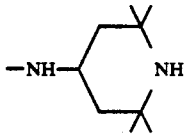 | 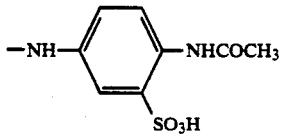 | 281 nm |

EXAMPLE 15

18.4 g of cyanuric chloride, 46.7 g of isopropanol and 17.4 g of sulfanilic acid are combined as described in DE-A-2,828,030 to prepare a solution of 4-N-(2-chloro-4-isopropoxy-6-triazinyl)aminobenzenesulfonic acid (sodium salt) in 100 ml of distilled water. 15.6 g of 4-amino-2,2,6,6-tetramethylpiperidine are then added at room temperature and the mixture is stirred at 70° C. for 16 h. Then about 70 ml of an isopropanol/water mixture are distilled off under reduced pressure. The mixture is cooled down to room temperature and filtered and the filter residue is washed chloride-free with distilled water. Drying at 60° C. under reduced pressure leaves 34.6 g of a colourless powder of the formula

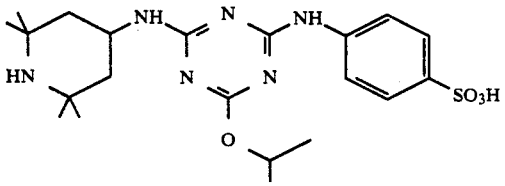

(115)

The longest-wavelength absorption maximum is 274 nm (water).

EXAMPLE 16

A suspension of 10.3 g of the sodium salt of 4-N-(2,4-dichloro-6-triazinyl)aminobenzenesulfonic acid in 50 ml of distilled water is admixed at 20° C. with a neutral solution of 5.2 g of sulfanilic acid in 30 ml of distilled water, added dropwise, while the pH of the reaction mixture is maintained between 6 and 7 by the simultaneous dropwise addition of 2M sodium hydroxide solution. The reaction mixture is subsequently stirred at 40° C. for 2.5 h. Then 4.7 g of 4-amino-2,2,6,6-tetramethylpiperidine are rapidly added and the mixture is stirred at 70° C. for 12 hours until the reaction has ended. The resulting reaction solution is evaporated to dryness at 70° C. under reduced pressure. This leaves 25.9 g of a colourless powder of the formula

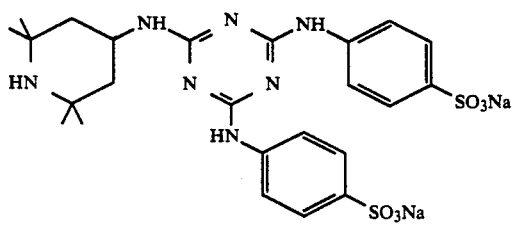

(116)

having an active content of 75%. The compound has the longest-wavelength absorption maximum at 284 nm (water).

EXAMPLE 17

An ice-cold suspension of 10.3 g of 4-N-(2,4-dichloro-6-triazinyl)aminobenzenesulfonic acid (sodium salt) is admixed with 3.15 g of diethanolamine. The reaction mixture is gradually warmed to 40° C. while the pH is maintained at between 6.5 and 7 by the dropwise addition of about 15 ml of 15% sodium carbonate solution. After 3 hours at 40° C. 4.7 g of 4-amino-2,2,6,6-tetramethylpiperidine are rapidly added. The mixture is subsequently stirred at 70° C. for 16 hours and then evaporated under reduced pressure. This leaves 11.8 g of a colourless powder of the formula

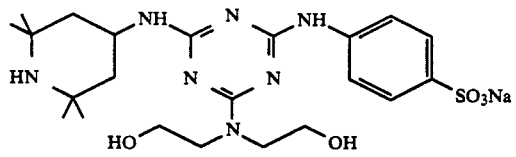

(117)

which has an active content of 73% and the longest-wavelength absorption maximum at 275 nm (water).

EXAMPLE 18

A suspension of 10.3 g of 2-N-(2,4-dichloro-6-triazinyl)aminobenzenesulfonic acid (sodium salt) in 100 ml of distilled water is admixed at 5° C. with 2.6 g of morpholine and warmed to 40° C. in the course of 1.5 hours while its pH is maintained at between 6.5 and 7 by the dropwise addition of 19 ml of 15% sodium carbonate solution. It is then stirred at 40° C. for 1 hour until the reaction has ended. The colourless suspension is admixed with 4.7 g of 4-amino-2,2,6,6-tetramethylpiperidine and heated to 70° C. It is stirred at that temperature for 15 hours, then cooled down to room temperature and filtered. The filter residue is washed with water and dried at 80° C. under reduced pressure. This leaves 11.7 g of a colourless compound of the formula

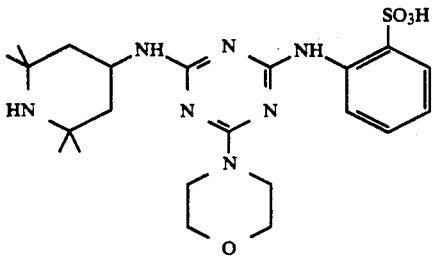

(118)

which has the longest-wavelength absorption maximum at 264 nm (water).

EXAMPLE 19

A suspension of 4.4 g of the compound of Example 1 in 30 ml of distilled water is turned into a solution by adding 2 ml of concentrated sodium hydroxide solution. The solution is then neutralised with concentrated hydrochloric acid, and a finely divided suspension forms. Then 5 ml of an aqueous solution of 0.94 g of phenol are added, and the mixture is heated at 90° C. for 15 hours. On cooling down to room temperature, the mixture is filtered, and the filter residue is washed with water and dried at 80° C. under reduced pressure. This leaves 4.7 g of a white powder of the formula

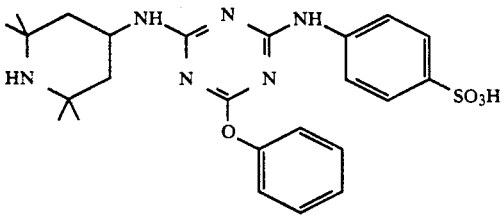

(119)

having the longest-wavelength absorption maximum at 275 nm (water).

EXAMPLE 20

A suspension of 10.3 g of 2-N-(2,4-dichloro-6-triazinyl)aminobenzenesulfonic acid (sodium salt) in 100 ml of distilled water is admixed at 5° C. with 3.3 g of thiophenol. The pH of the reaction mixture is maintained between 6.5 and 7 by the dropwise addition of 15% sodium carbonate solution and the internal temperature is at the same time allowed to rise to room temperature. Then the reaction mixture is stirred at 40° C. for an hour until the reaction has ended, 4.7 g of 4-amino-2,2,6,6-tetramethylpiperidine are added, and the mixture is heated at 70° C. for 16 hours. After cooling down to room temperature, the reaction mixture is comminuted in a mixer and filtered, and the filter residue is washed with water, suspended in 100 ml of ethanol, filtered off, washed with ethanol and dried at 80° C. under reduced pressure. This leaves 9.7 g of a colourless compound of the formula

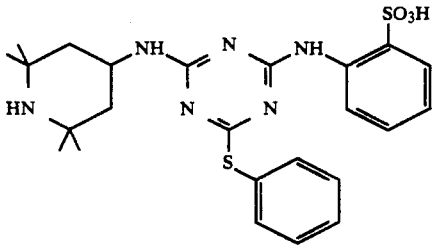

(120)

of melting point 354° C.

EXAMPLE 21

A solution of 5.9 g of 2,4-dichloro-6-methylthio-s-triazine in 30 ml of acetone is stirred into 50 ml of ice-water. Then 100 ml of a neutral aqueous solution of 5.2 g of sulfanilic acid are added dropwise and the pH of the reaction mixture is maintained between 6.5 and 7 by the dropwise addition of 15% sodium carbonate solution. This is followed by heating at 40° C. for one hour and then the acetone is distilled off under reduced pressure. The reaction mixture is rapidly admixed with 4.7 g of 4-amino-2,2,6,6-tetramethylpiperidine and stirred at 70° C. for 2 hours. The suspension is cooled down to room temperature and filtered, and the filter residue is washed with distilled water and dried at 80° C. under reduced pressure to leave 13.1 g of a colourless compound of the formula

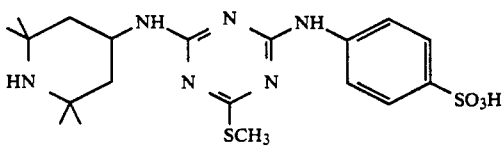

(121)

which has the longest-wavelength absorption maximum at 281 nm (water).

EXAMPLE 22

A suspension of 9.95 g of the sodium salt of 2-N-(2,4-dichloro-6-triazinyl)aminobenzenesulfonic acid in 100 ml of distilled water is admixed at 5° C. with 5.0 g of 4-amino-1-oxazido-2,2,6,6-tetramethylpiperidine and stirred at room temperature for 16 hours. Then the orange suspension is converted into a solution at pH 10 by the addition of concentrated sodium hydroxide solution. 7.8 g of sodium dithionite are then added, and the reaction mixture is stirred at room temperature until completely decolourised. It is then neutralised with concentrated hydrochloric acid and filtered, and the filter residue is washed with distilled water and dried at 50° C. under reduced pressure to leave 6.1 g of a colourless powder of the formula

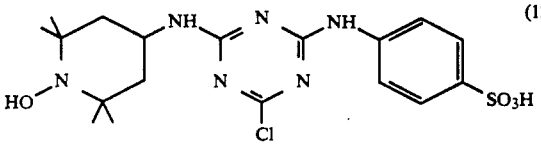

(122)

having the longest-wavelength absorption maximum at 279 nm (water).

Example 23a (intermediate)

A suspension of 22.6 g of 2-phenyl-4,6-dichloro-s-triazine in 150 ml of acetone is poured onto 100 ml of ice-water with stirring and then admixed with a neutral solution of 17.3 g of sulfanilic acid in 100 ml of distilled water. The internal temperature is allowed to rise to 10°-15° C. and the pH of the reaction mixture is maintained at 6 by the dropwise addition of 30% sodium hydroxide solution (amount required: 13 ml). Then the mixture is stirred at 40° C. for 15 hours. The resulting solution is cooled down to room temperature. The precipitated product is filtered off with suction, washed with 20% sodium chloride solution and dried at 50° C. under reduced pressure. This leaves 39.1 g of a white powder of the formula

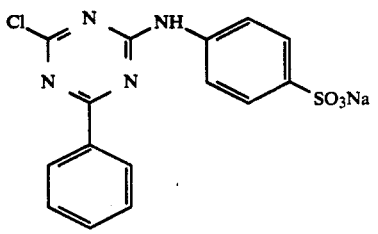
(123a)

having an active content of 90.1%.

EXAMPLE 23

A suspension of 12.8 g of the compound of the formula (123a) in 70 ml of distilled water is admixed at room temperature with 4.7 g of 4-amino-2,2,6,6-tetramethylpiperidine by stirring. The mixture is subsequently stirred at 55° C. for 30 minutes, which converts it into a solution, and then at 80° C. for one hour. It is finally stirred at 55° C. for 15 hours. After cooling down to room temperature, the precipitate is filtered off with suction, washed chloride-free with distilled water and dried at 50° C. under reduced pressure to leave 13.5 g of a colourless compound of the formula

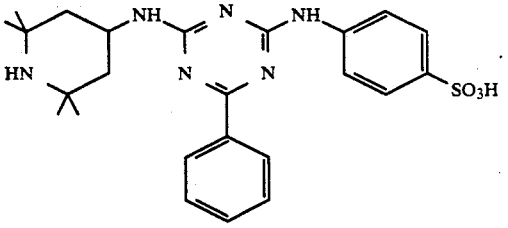
(123)

The longest-wavelength absorption maximum is 262 nm (water).

EXAMPLE 24

A suspension of 12.8 g of the compound of the formula (123a) in 70 ml of distilled water is admixed at room temperature with 5.1 g of 4-N-methylamino-2,2,6,6-tetramethylpiperidine by stirring. The mixture is subsequently stirred at 55° C. for one hour and at 70° C. for 18 hours. After cooling down to room temperature, the resulting precipitate is filtered off with suction, washed chloride-free with distilled water and dried at 55° C. under reduced pressure to leave 14.1 g of a colourless compound of the formula

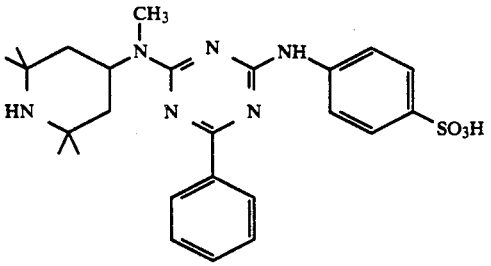
(124)

having the longest-wavelength absorption maximum at 265 nm (water).

EXAMPLE 25

A suspension of 12.8 g of the compound of the formula (123a) in 70 ml of distilled water is admixed at room temperature with 6.4 g of 4-N-butylamino-2,2,6,6-tetramethylpiperidine by stirring. The reaction mixture is stirred at 70° C. for 4 hours, cooled down to room temperature and filtered. Washing with distilled water and drying at 55° C. under reduced pressure leaves 15.2 g of a colourless powder of the formula

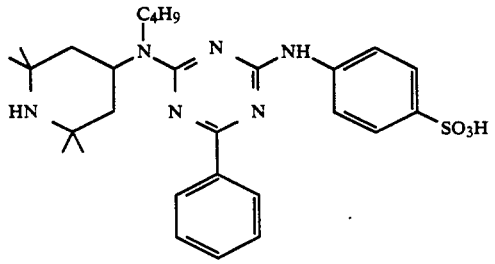
(125)

The longest-wavelength absorption maximum is 255 nm (methanol).

EXAMPLE 26

A suspension is prepared of the sodium salt of 4-N-methyl-(2-chloro-4-phenyl-6-s-triazinyl)aminobenzenesulfonic acid by reacting 5.65 g of 2-phenyl-4,6-dichloro-s-triazine with 4.7 g of N-methylsulfanilic acid under the reaction conditions of Example 23a. Then 4.3 g of 4-N-methylamino-2,2,6,6-tetramethylpiperidine are added at 40° C. with stirring and the temperature is raised to 75° C. The mixture is subsequently stirred at that temperature for 18 hours, cooled down to room temperature and filtered with suction. The filter residue is washed with distilled water and dried at 55° C. under reduced pressure to leave 12.6 g of a colourless compound of the formula

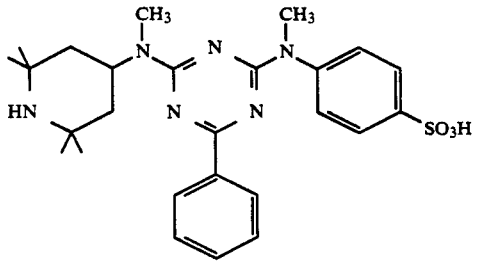
(126)

which has the longest-wavelength absorption maximum at 250 nm (methanol).

EXAMPLE 27

Example 23a is repeated, except that the 2-phenyl-4,6-dichloro-s-triazine is replaced by 2-p-tolyl-4,6-dichloro-s-triazine and the sulfanilic acid by metanilic acid. This produces the corresponding 3-N-(2-chloro-4-p-tolyl-6-s-triazinyl)aminobenzenesulfonic acid in the form of the sodium salt. This compound is condensed directly, without isolation, with 4-amino-1,2,2,6,6-pentamethylpiperidine under the reaction conditions of Example 24 to obtain a colourless powder of the formula

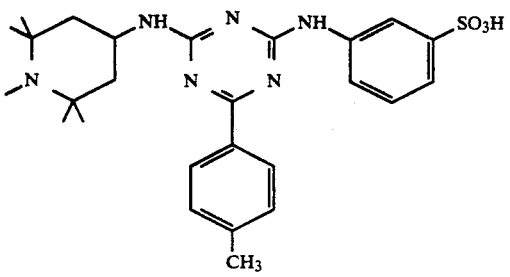

(127)

The longest-wavelength absorption maximum is 265 nm (water).

EXAMPLE 28

A solution of 4.9 g of 2,4-dichloro-6-methyl-s-triazine in acetone (50 ml) is discharged onto ice-water (50 ml). A neutral solution of 5.2 g of sulfanilic acid is then added at 10° C. with rapid stirring and the pH of the reaction mixture is maintained at 6 by the dropwise addition of 30% sodium hydroxide solution. The amount of sodium hydroxide solution consumed is 4.1 ml. The mixture is then stirred at room temperature for one hour and at 40° C. for 3 hours until the reaction has ended. 5.1 g of 4-N-methylamino-2,2,6,6-tetramethylpiperidine are then rapidly added and the temperature is raised to 55° C. in the course of 30 minutes. Finally the mixture is stirred at that temperature for one hour. After cooling down to room temperature, the reaction mixture is left to stand overnight. The precipitate is filtered off with suction, washed with distilled water and dried at 50° C. under reduced pressure to leave 9.9 g of a colourless compound of the formula

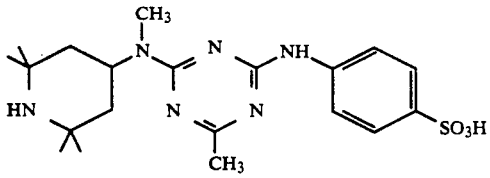

(128)

which has the longest-wavelength absorption maximum at 276 nm (water).

Application examples

EXAMPLE 29

4 samples, each of 10 g, of a knitted nylon 6 fabric are prepared and treated in a dyeing machine, for example an ®AHIBA dyeing machine, at a liquor ratio of 30:1. Two of these samples are dyed blank (i.e. without dye: liquors 1 and 3), whereas 2 are dyed (liquors 2 and 4).

Thus, 4 dyeing liquors are prepared, each containing 0.5 g/l of monosodium phosphate and 1.5 g/l of disodium phosphate (≙pH 7). The following dyes are dissolved in liquors 2 and 4 (percentages on weight of fibre):

0.04% of the dye mixture consisting of 81 parts of the compound of the formula

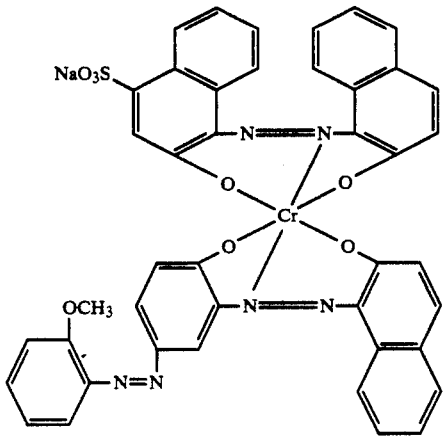

(Ia)

1:2 Cr complex and 12 parts of the compound of the formula

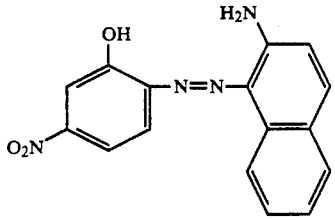

(Ib)

1:2 Co complex (the remaining 7 parts are salts and surfactants) and 0.002% of the dye of the formula

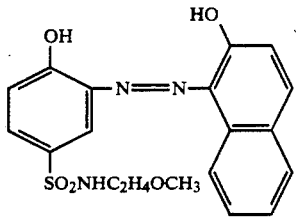

(II)

1:2-Co complex

Liquors 3 and 4 additionally contain 1% of the sodium salt of the compound of the formula (101).

The prepared textile material is introduced into the liquors at 40° C. and left at that temperature for 10 minutes. Then the temperature is raised to 95° C. over 30 minutes. After a treatment time of 20 minutes 2% of acetic acid (80%) are added and the treatment is continued for a further 20 minutes. Finally, after cooling down to 60° C., the samples are rinsed, centrifuged and dried.

The dyeings are examined in respect of their light fastness in accordance with SN-ISO 105-B02 (=XENON) and DIN 75202 (=FAKRA) and are then subjected to a heat test at 130° C. for 60 hours to examine the hue stability. The blank dyeings are irradiated in accordance with DIN 75202 for 216 hours before the breaking strength and extension are determined in accordance with SN 198,461.

The following results are obtained:

TABLE II

| | Light fastness | | | Break strength/ extension % | Heating test 130°; 60 h |
|---|---|---|---|---|---|
| | Xenon | Fakra 144 h | Fakra 216 h | | |
| Liquor 1 | — | — | — | 7.5/27.4 | — |
| Liquor 2 | 7 | *1H | *1H | — | Hue: beige |
| Liquor 3 | — | — | — | 74.4/85.5 | — |
| Liquor 4 | 7-8 | 3-4 | 2-3 | — | Hue: grey (hardly changed) |

*no breaking strength left

It is evident that application of the compound of the formula (101) confers distinct photochemical and thermal stability on the fibre material or dyeing.

Example 30

Two samples, 10 g each, of a knitted nylon 6 fabric are dyed as described in Example 29, except that the two liquors contain the following dyes:

0.05% of the dye of the formula (III)

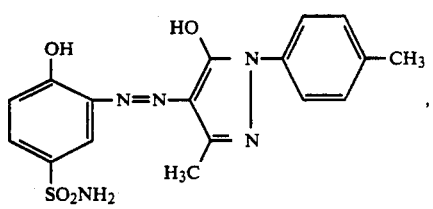

1:2 Co complex 0.085% of the dye mixture of the formulae

1:2 Co mixed complex

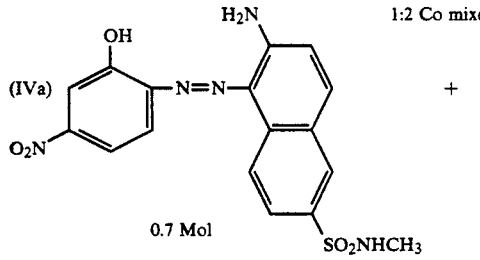

0.7 Mol

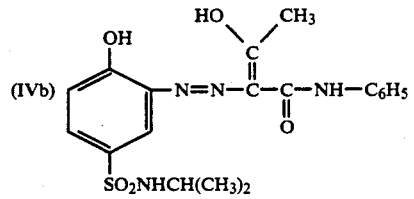

0.3 Mol and also 0.035% of the dye mixture of the formulae (Ia) and (Ib).

Liquor (2) additionally contains 1% of the sodium salt of the compound of the formula (101).

Testing the light fastness and heat stability of the dyeings produces the following result (Table III):

TABLE III

| | Light fastness | | | Heating test 130°; 60 h |
|---|---|---|---|---|
| | Xenon | Fakra 144 h | Fakra 216 h | |
| Liquor 1 | 7 | *1H | *1H | Hue: olive →brown |
| Liquor 2 | 7-8 | 2-3 | 1-2 | Hue: hardly changed |

*no breaking strength left

Examples 31 and 32

Pale grey and olive dyeings are prepared in a conventional manner on nylon 6 double jersey as described in Examples 29 and 30. These dyeings are impregnated on a pad-mangle (squeeze-off effect 105%) with solutions which contain 10 g/l of the compounds of the formulae (105) and (107) in solution. The padded dyeings are put onto a batching roller and then left wrapped in polyethylene film for 2 hours. They are then dried at 80° C.

On subjecting these dyeings to light fastness and heat testing, the results obtained again indicate an increased photochemical and thermal stability.

Example 33

Example 30 is repeated, except that the compound of the formula (101) in liquor 2 is replaced by the compound of the formula (108).

The dyeings are tested in respect of their light fastness in accordance with DIN 75202 (FAKRA). The two dyeings are for this purpose irradiated by the same method over an area of about 4×12 cm for 216 hours and then subjected to a test of their breaking strength and extension in accordance with SN 198,461. The results are given in Table IV:

TABLE IV

| | *Light fastness according to FAKRA | | Breaking strength/ extension |
|---|---|---|---|
| DYEING | 144 hours | 216 hours | (% of original value) |
| 1 | 1 | 1 | 10.7/16.2 |
| 2 | 2-3 | 2 | 76.7/79.2 |

*Assessment according to grey scale 1-5

The result shows that the compound of the formula (108) produces a distinct stabilisation of the fibre polymer and of the dye itself.

Examples 34 and 35

Three samples, each of 10 g, of a knitted nylon fabric are prepared, dyed and finished as described in Example 29, using the same dye combination. The liquor for dyeing No. 1 does not contain any further additives, liquor 2 contains an additional 0.75% of the sodium salt of the compound of the formula (111), and dyeing liquor 3 contains 0.75% of the sodium salt of the compound of the formula (110).

The determination of the light fastness properties of the dyeings in accordance with SN-ISO 105-B02 (XENON) and DIN 75202 (FAKRA) produce the following results (Table V):

TABLE V

| | LIGHT FASTNESS PROPERTIES according to | | |
|---|---|---|---|
| GREY DYEING | XENON | FAKRA 144 h | FAKRA 216 h |
| 1 (without addition) | 6-7 | 1(*) | 1(*) |
| 2 [+ compound (111)] | 7-8 | −3 | 2+ |

TABLE V-continued

| GREY DYEING | LIGHT FASTNESS PROPERTIES according to XENON | FAKRA 144 h | FAKRA 216 h |
|---|---|---|---|
| 3 [+ compound (110)] | 7 | 2–3 | 2 |

(*)no breaking strength left

It is clear from the results that the compounds (110) and (111) greatly improve the photochemical stability of the grey dyeings. The dyeing without stabiliser is unusable as regards its mechanical strength and its light fastness.

Example 36

10 samples, of 10 g each, of polyamide jersey and 10 liquors are prepared as described in Example 29. Liquors 1 to 5 each contain 0.04% of the dye mixture of the formulae (Ia) and (Ib) and 0.002% of the dye of the formula (II) in dissolved form, while liquors 6 to 10 are for blank dyeings without any further addition of dye. Liquors 2 and 7 each contain 0.75% of the sodium salt of the compound of the formula (109), liquors 3 and 8 each contain 0.75% of the compound of the formula (112), liquors 4 and 9 each contain 0.75% of the compound of the formula (113) and liquors 5 and 10 each contain 0.75% of a compound of the formula (114) in dissolved form. All the 10 samples are treated and finished as described in Example 29. Dyeings 1 to 5 are tested in respect of their light fastness properties in accordance with DIN 75202 (FAKRA). Blank dyeings 6–10 are irradiated for 216 hours in accordance with SN-ISO 105-B02 (=XENON) and DIN 75202 (FAKRA) and tested in respect of their breaking strength and extension in accordance with SN 198,451 with the following results (Table VI):

TABLE VI

| SAMPLE OF | | LIGHT FASTNESS XENON | FAKRA 144 hours | FAKRA 216 hours | BREAKING STRENGTH/ EXTENSION (%) |
|---|---|---|---|---|---|
| Liquor 1 | • | 7 | 1H* | 1H* | — |
| Liquor 6 | | — | — | — | 3.9/22.8 |
| Liquor 2 | x | 7–8 | 3–4 | 2–3 | — |
| Liquor 7 | | — | — | — | 61.7/73.7 |
| Liquor 3 | Δ | 7–8 | 3–4 | 2–3 | — |
| Liquor 8 | | — | — | — | 66.2/74.7 |
| Liquor 4 | □ | 7–8 | 3–4 | 2–3 | — |
| Liquor 9 | | — | — | — | 79.3/84.9 |
| Liquor 5 | ∘ | 7–8 | 2–3 | 2 | — |
| Liquor 10 | | — | — | — | 62.4/77.4 |

*sample no longer resistant to breaking
• no addition
x + compound of the formula (109)
Δ + compound of the formula (112)
□ + compound of the formula (113)
∘ + compound of the formula (114)

The results show that the compounds of the formulae (109), (112), (113) and (114) confer a distinct photochemical stabilisation on the polyamide material.

Example 37

Example 29 is repeated, i.e. blank treatments and pale grey dyeings are prepared alternately and tested. Thus, the prepared dyeing liquors 1,3,5,7, 9 (=blank dyeing) and 2, 4, 6, 8, 10 (=dyeings) each contain 0.25% of the compounds of the formulae (122), (123), (127) and (128). The results can be seen in Table VII, where the blank dyeings are characterised in terms of the breaking strength and extension (irradiation in accordance with DIN 75202 (=FAKRA) and tested in accordance with SN 198,451) and the dyeings in terms of their light fastness properties (DIN 75202/FAKRA).

TABLE VII

| LIQUOR No./ADDITION | BREAKING STRENGTH/ EXTENSION (%) after exposure after 216 h FAKRA | LIGHT FASTNESS FAKRA 144 h | FAKRA 216 h |
|---|---|---|---|
| Liquor 1: no addition | 7.9/28.6 | — | — |
| Liquor 2: no addition | | 1H | 1H |
| Liquor 3: +0.25% of the compound of the formula (123) | 75.8/82.1 | — | — |
| Liquor 4: +0.25% of the compound of the formula (123) | — | 3 | 2–3 |
| Liquor 5: +0.25% of the compound of the formula (128) | 58.0/71.6 | — | — |
| Liquor 6: +0.25% of the compound of the formula (128) | — | 2–3 | 1–2 |
| Liquor 7: +0.25% of the compound of the formula (127) | 64.3/72.0 | — | — |
| Liquor 8: +0.25% of the compound of the formula (127) | — | 3 | 2–3 |
| Liquor 9: +0.25% of the compound of the formula (122) | 87.9/88.5 | — | — |
| Liquor 10: +0.25% of the compound of the formula (122) | — | 3–4 | 3 |

What is claimed is:

1. A water-soluble triazine derivative of the formula

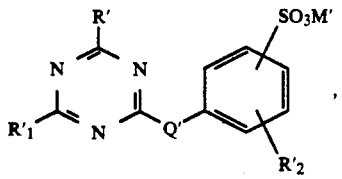

(5)

where $R'_1$ is a radical of the formula

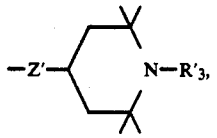

(6)

where $R'_3$ is hydrogen, oxido, hydroxyl, lower alkyl, lower alkenyl, lower alkoxy, lower alkanoyl or benzoyl or benzyl and Z' is —(NR'$_4$)—, where $R'_4$ is hydrogen or lower alkyl, $R'_2$ is hydrogen, halogen, lower alkyl, lower alkoxy, lower alkanoyl or benzoyl amino, carboxyl, an unsubstituted or halogen- or (lower alkyl)-substituted phenylsulfo, phenoxy, phenylthio or styryl radical or —$SO_3M$, Q' is O or —(NR'$_4$)—, R' is lower alkyl, lower alkoxy, phenyl(lower alkoxy), $C_4$–$C_8$cycloalkoxy, (lower alkyl)thio, phenyl(lower alkyl)thio, $C_4$–$C_8$cycloalkylthio, mono(lower alkyl)amino, di(lower alkyl)amino, $C_4$–$C_8$cycloalkylamino, phenoxy, phenylamino, lower alkyl substituted phenylamino, phenylthio, phenyl, 1-aza-$C_4$–$C_8$cycloalkyl, morpholino, $R'_1$ or a radical of the formula

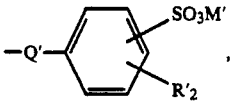

(7)

where $R'_2$ and Q' are each as defined for the formula (5), M' is hydrogen, an alkali metal, an alkaline earth metal, ammonium or an organic ammonium radical, the compounds of the formula (5) having not more than 2 $SO_3M'$ substituents.

2. A water-soluble triazine derivative according to claim 1, wherein R' is a radical of the formula (7) and $R'_1$ is a radical of the formula (6).

3. A water-soluble triazine derivative according to claim 1, wherein R' and $R'_1$ are each a radical of the formula (6).

4. A water-soluble triazine derivative according to claim 1, wherein R' is lower alkoxy, $C_4$–$C_8$cycloalkoxy, phenoxy, phenylalkoxy, (lower alkyl)thio, phenylthio or phenylalkylthio.

* * * * *

UNITED STATES PATENT AND TRADEMARK OFFICE

CERTIFICATE OF CORRECTION

PATENT NO. : 5,281,707

DATED : Jan. 25, 1994

INVENTOR(S) : Fuso et al.

It is certified that error appears in the above-identified patent and that said Letters Patent is hereby corrected as shown below:

Column 25, line 21 should read:

-- or benzyl and Z'is -O- or —$(NR'_4)$—, where $R'_4$ is hydrogen--.

Column 25, line 26 should read:

-- radical or —$SO_3M$, Q' is —$(NR'_4)$—, R' is lower--.

Signed and Sealed this

Twenty-third Day of August, 1994

*Attest:*

*Attesting Officer*

BRUCE LEHMAN

*Commissioner of Patents and Trademarks*